US007302779B2

(12) United States Patent
Endre

(10) Patent No.: US 7,302,779 B2
(45) Date of Patent: Dec. 4, 2007

(54) METHOD AND APPARATUS FOR MASONRY CHIMNEY FLUE REPAIR

(76) Inventor: Jay Endre, 10080 Minder La., Warrenton, VA (US) 20186

( * ) Notice: Subject to any disclaimer, the term of this patent is extended or adjusted under 35 U.S.C. 154(b) by 752 days.

(21) Appl. No.: 10/757,537

(22) Filed: Jan. 15, 2004

(65) Prior Publication Data

US 2005/0013889 A1 Jan. 20, 2005

Related U.S. Application Data

(60) Provisional application No. 60/448,140, filed on Feb. 20, 2003.

(51) Int. Cl.
*E04D 15/00* (2006.01)
*E04F 21/00* (2006.01)
*E04G 21/14* (2006.01)

(52) U.S. Cl. ..... 52/749.1; 52/219; 52/749.15; 52/745.21; 52/302.3; 52/218

(58) Field of Classification Search ..... 52/218, 52/219, 302.3, 749.1, 749.15, 747.13, 745.21; 454/7, 13, 16; 425/11, 13; 246/30
See application file for complete search history.

(56) References Cited

U.S. PATENT DOCUMENTS

| | | | | | |
|---|---|---|---|---|---|
| 1,147,374 | A | | 7/1915 | Coe | |
| 1,313,013 | A | * | 8/1919 | Polysu | 264/32 |
| 2,306,037 | A | * | 12/1942 | Colvin | 425/59 |
| 2,421,666 | A | * | 6/1947 | Upson et al. | 405/234 |
| 2,560,619 | A | * | 7/1951 | Wertz | 405/267 |
| 2,894,739 | A | * | 7/1959 | Spencer | 266/281 |
| 3,131,768 | A | * | 5/1964 | Chancellor et al. | 285/148.1 |
| 3,193,901 | A | * | 7/1965 | Lee et al. | 425/59 |
| 3,434,294 | A | * | 3/1969 | Hall | 405/238 |
| 3,726,240 | A | * | 4/1973 | Emich | 112/470.01 |
| 3,880,967 | A | | 4/1975 | Loggins et al. | |
| 4,055,958 | A | | 11/1977 | Hanson | |
| 4,205,949 | A | | 6/1980 | Hanson | |
| 4,208,757 | A | * | 6/1980 | Baugh et al. | 15/249.1 |
| 4,252,763 | A | * | 2/1981 | Padgett | 264/133 |
| 4,253,813 | A | | 3/1981 | Farrell, Jr. | |
| 4,415,269 | A | * | 11/1983 | Fraser | 366/132 |
| 4,490,876 | A | * | 1/1985 | Haberl | 15/249.1 |
| 4,963,191 | A | * | 10/1990 | LaFleur | 106/698 |
| 5,019,417 | A | * | 5/1991 | Northcutt | 427/521 |
| 5,092,265 | A | * | 3/1992 | Hughes et al. | 118/317 |
| 5,198,246 | A | * | 3/1993 | Bowen | 425/432 |
| 6,401,759 | B1 | * | 6/2002 | Kamiyama et al. | 138/98 |
| 6,969,427 | B1 | * | 11/2005 | Noles, Jr. | 118/317 |
| 7,029,254 | B2 | * | 4/2006 | Gozu et al. | 425/11 |

* cited by examiner

*Primary Examiner*—Richard E. Chilcot, Jr.
*Assistant Examiner*—Chi Q. Nguyen
(74) *Attorney, Agent, or Firm*—Richard C. Litman

(57) ABSTRACT

An apparatus for repairing cracks, crevices, joints, and other discontinuities in a chimney flue liner, comprises a flexible, resilient applicator having a liquid impervious rubberized coating. An electrical vibrator is installed within the applicator, for tamping the mortar or grout material into any discontinuities in the flue liner. A method of using the apparatus is also disclosed, comprising drawing the applicator downwardly through the flue from top to bottom, connecting the vibrator to a suitable source of electrical power, placing the applicator at the bottom end of the flue, pouring mortar or grout material into the chimney from the top with the mortar flowing to the sides of the applicator and between the applicator and flue liner, and drawing the applicator upwardly through the flue liner while operating the vibrator to coat the interior of the flue liner and tamp the repair material thoroughly into any discontinuities in the liner.

6 Claims, 3 Drawing Sheets

METHOD AND APPARATUS FOR MASONRY CHIMNEY FLUE REPAIR

CROSS-REFERENCE TO RELATED APPLICATION

This application claims the benefit of U.S. Provisional Patent Application Ser. No. 60/488,140, filed Feb. 20, 2003.

BACKGROUND OF THE INVENTION

1. Field of the Invention

The present invention relates generally to masonry work, including grouting and mortaring of masonry structures. More specifically, the present invention comprises a relatively soft and pliable, resilient device for applying grout, mortar, or a similar substance to the flue liner of a chimney or the like. The present applicator includes an electrically powered vibrator therein, to assist in tamping or packing the grout material against the interior of the flue liner and into any crevices and gaps within the flue liner.

2. Description of Related Art

Conventional masonry chimneys and similar structures incorporate a flue liner formed of a refractory material of some sort, e.g., vitreous clay or the like, with a brick or other masonry wall or veneer applied about the exterior of the flue liner. These flue liners are capable of withstanding relatively high temperatures when in proper condition. However, age, poor workmanship and/or materials, and/or other factors can result in their deterioration and need for repair.

As a result, various techniques have been developed in the past for relining or repairing cracks, crevices, gaps, and other damage to the flue liners in masonry chimney construction. The general object of these various devices and techniques is to affect an economical and safe repair, and prolong the life of the chimney and flue. However, due to the flue repair apparatus developed in the past, the materials and labor involved are generally rather high. While such repair may be more economical than tearing down and rebuilding the entire chimney, it can nevertheless result in a considerable expenditure for the chimney owner. Moreover, the use of relatively rigid devices passing through the flue liner can result in less than optimum repair and sealing of the flue liner due to uneven joints between liner sections and other problems. Such rigid metal devices must of course be constructed so as to provide sufficient clearance through the flue at all points of travel, which can result in relatively wide gaps between the tool and the flue interior at some points and corresponding irregularities in the thickness and consistency of the material applied to the interior of the flue.

Accordingly, a need will be seen for a masonry chimney repair apparatus and method which accommodates such irregularities within the flue liner, and provides a relatively uniform application of the grout or other material within the flue liner. More importantly, the apparatus and method must provide a positive means of assuring that any critical cracks, crevices, joints, gaps, etc. in the flue liner, are completely filled and sealed with the grout or other material used. The present invention accomplishes this requirement by means of a relatively soft and resilient foam or sponge applicator which is configured to fit closely within the dimensions of the flue. The exterior surface of the applicator is coated with a rubberized material (e.g., a tripolymer substance) for flexibility and to preclude the adhesion of grout material thereto. Moreover, the present invention includes an electric vibrator within the foam or sponge applicator, in order to tamp or compact the grout material solidly within any cracks, crevices, and gaps within the flue liner.

A discussion of the related art of which the present inventor is aware, and its differences and distinctions from the present invention, is provided below.

U.S. Pat. No. 1,147,374 issued on Jul. 20, 1915 to Wash Coe, titled "Chimney Lining Apparatus," describes a multiple purpose apparatus for chimney flue repair. The Coe device includes a series of attachments for washing and brushing out loose mortar, and for reapplying fresh mortar to the interior of the flue. The applicator and trowel assembly used in the Coe device is relatively complex, comprising a pair of relatively thin and flexible mortar applicators and a trowel below the applicators. The trowel is formed of a series of rigid metal sheets, and is adjustable to fit different sizes of chimney flues. Coe also provides two concentric pipes or tubes, with the inner pipe used to lower and lift his apparatus, and the surrounding outer pipe used as a conduit for mortar. Coe does not disclose the use of a vibrator device installed within a solid, three-dimensional applicator formed of a coated resilient foam material, as provided by the present invention.

U.S. Pat. No. 3,880,967 issued on Apr. 29, 1975 to Joseph R. Loggins et al., titled "Method For Lining Gun Brick In Coke Ovens," describes a method using a rigid metal tube which is inserted into the flue of a coke oven, as used in the manufacture of steel. Grout is poured or forced between the steel tube and the interior of the oven flue, with the tube remaining fixed in position during the operation. No tamping vibrator or resilient applicator is disclosed by Loggins et al.

U.S. Pat. No. 4,055,958 issued on Nov. 1, 1977 to Raymond A. Hanson, titled "Slipforming Method And Apparatus For In Situ Lining Of An Upwardly Open Shaft With Monolithic Concrete," describes a method and apparatus for lining a drilled shaft, rather than a chimney flue or the like. The Hanson device comprises a pair of closely fitting shells, with the distance between the outer edge of the inner shell and the wall of the shaft defining the thickness of the concrete liner as it is applied. Concrete is forced down the pipe suspending the apparatus and between the outer or upper and lower or inner shells of the device, where it is extruded from the edge of the gap between the shells. While Hanson provides a tamping vibrator in his device, he does not provide any form of flexible, resilient applicator, as provided in the present invention.

U.S. Pat. No. 4,205,949 issued on Jun. 3, 1980 to Raymond A. Hanson, titled "Slipform Apparatus For Vertical Bores," describes a complex, multi-segmented device. The devices of the '949 and '958 (discussed immediately above) U.S. patents to the same inventor are closely related, and are directed to forming a lining within a relatively deep drilled hole, rather than repairing an existing flue liner within a chimney or the like. The device of the Hanson '949 U.S. patent is formed of a series of rigid cylindrical sections, with flexibility provided by a steering mechanism to allow the segments to turn to follow bends in the path of the hole. No flexible, resilient foam applicator or tamping vibrator mechanism is disclosed in the Hanson '949 U.S. patent.

U.S. Pat. No. 4,253,813 issued on Mar. 3, 1981 to Eugene C. Farrell, Jr., titled "Apparatus For Applying A Flowable Coating Material To The Interior Of A Stack," describes a two sided or edged trowel device which may be pushed through the chimney from below, or drawn through the chimney from above. The device is somewhat smaller than the interior span of the chimney, and thus requires additional apparatus to hold the device against the flue walls to which the concrete or other mortar is being applied. The mortar is forced upwardly from below to the applicator, rather than being poured downwardly to the applicator, as in the present invention. Farrell, Jr. does not disclose any form of tamping vibrator or the use of a flexible, resilient material for the applicator, as in the applicator of the present invention.

British Patent Publication No. 2,045,911 published on Nov. 5, 1980 to Peter Roth, titled "Method And Apparatus For Providing Chimney Flues With Insulated Coatings," describes a "vibrating bell" which is lowered into a chimney, with a loose particulate substance poured around the bell and tamped into place due to the vibrations. The primary point of the disclosure is the lifting means for the bell, and the load sensing apparatus for indirectly detecting the amount of material applied atop the bell during operation. No flexible, resilient applicator, lower draw-down line or cable, or use of a liquid or plastic mortar or grout material is disclosed in the '911 British Patent Publication.

Finally, Japanese Patent Publication No. 62-80,424 issued on Apr. 13, 1987 to Nippon Steel Corporation, titled "Repairing Method For Chimney Lining," describes (according to the drawings and English abstract) the repair of a refractory furnace chimney. A metal shell is installed within the chimney, and repair material is packed between the metal shell and the chimney wall. The metal shell is of course rigid, and cannot provide the resiliency of the present applicator. Moreover, the shell apparently remains fixed in place after the repair has been completed, or at least the shell does not move during the repair process. No tamping vibrator means is apparent in the '424 Japanese Patent Publication.

None of the above inventions and patents, taken either singly or in combination, is seen to describe the instant invention as claimed.

SUMMARY OF THE INVENTION

The present invention is a chimney flue repair apparatus comprising a three-dimensional applicator or plug which is configured to closely match the internal cross section of the chimney flue to which the repair is being made. The applicator is formed of a resilient, rubberized foam material, to allow it to conform to irregularities within the flue liner. The resilient applicator is coated with an impervious and flexible rubberized coating which prevents any mortar or grout from sticking to the applicator, and which seals the porous resilient applicator material. A conventional vibrator device is installed within the applicator, with the vibrator being housed in an aluminum canister for protection. Electrical power for the vibrator is provided by conventional 115 volt ac household electrical power via an extension cord. The present chimney flue repair apparatus is used by drawing it downwardly through the chimney flue, pouring the liquid or plastic mortar or grout material onto the applicator from above, and drawing the applicator upwardly through the flue to force the grout material against the sides of the flue and into any cracks, crevices, or joints therein.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention essentially comprises a reusable apparatus for repairing cracks, gaps, crevices, and other irregularities occurring in flue liners of chimneys, and a method of using the apparatus. Chimney flue liners are conventionally formed of materials such as vitreous clay, which are capable of withstanding extremely high heat without significant deterioration, at least in the short term. However, such materials are relatively brittle, and are prone to cracking and other forms of deterioration and damage over the years. Also, substandard workmanship during construction can result in excessive gaps and/or misalignment between flue liner sections. While such gaps and misalignment can be corrected to a certain extent by filling them with mortar during construction, the excessive mortar is prone to decomposition and deterioration over time. Poor equipment and technique used during chimney cleaning operations can damage flue liners, as well.

As a result, a number of different devices have been developed for the repair of damaged chimney flue liners. All of the devices of the prior art of which the present inventor is aware, are formed of relatively rigid materials, or at least relatively thin, two dimensional sheets of material which flex along their edges. These devices serve to coat the interior of the flue liner with a fresh coating of mortar, and thus provide some additional protection and prolong the life of the flue liner to some extent. However, they cannot effectively force the repair material (mortar or grout) deeply into any cracks, crevices, fissures, gaps, and other irregularities in the chimney flue liner.

Accordingly, the present invention provides a flue liner repair apparatus comprising a mortar or grout applicator which is formed of a resilient foam material, thus conforming closely to the interior contours and surface irregularities of the chimney flue liner as the applicator is drawn therethrough. The present applicator further includes an electrically powered vibrator therein, which serves to tamp or pack the repair material more deeply into the cracks, crevices, and irregularities of the flue liner, than can be accomplished using conventional flue liner repair tools.

Figure 1:
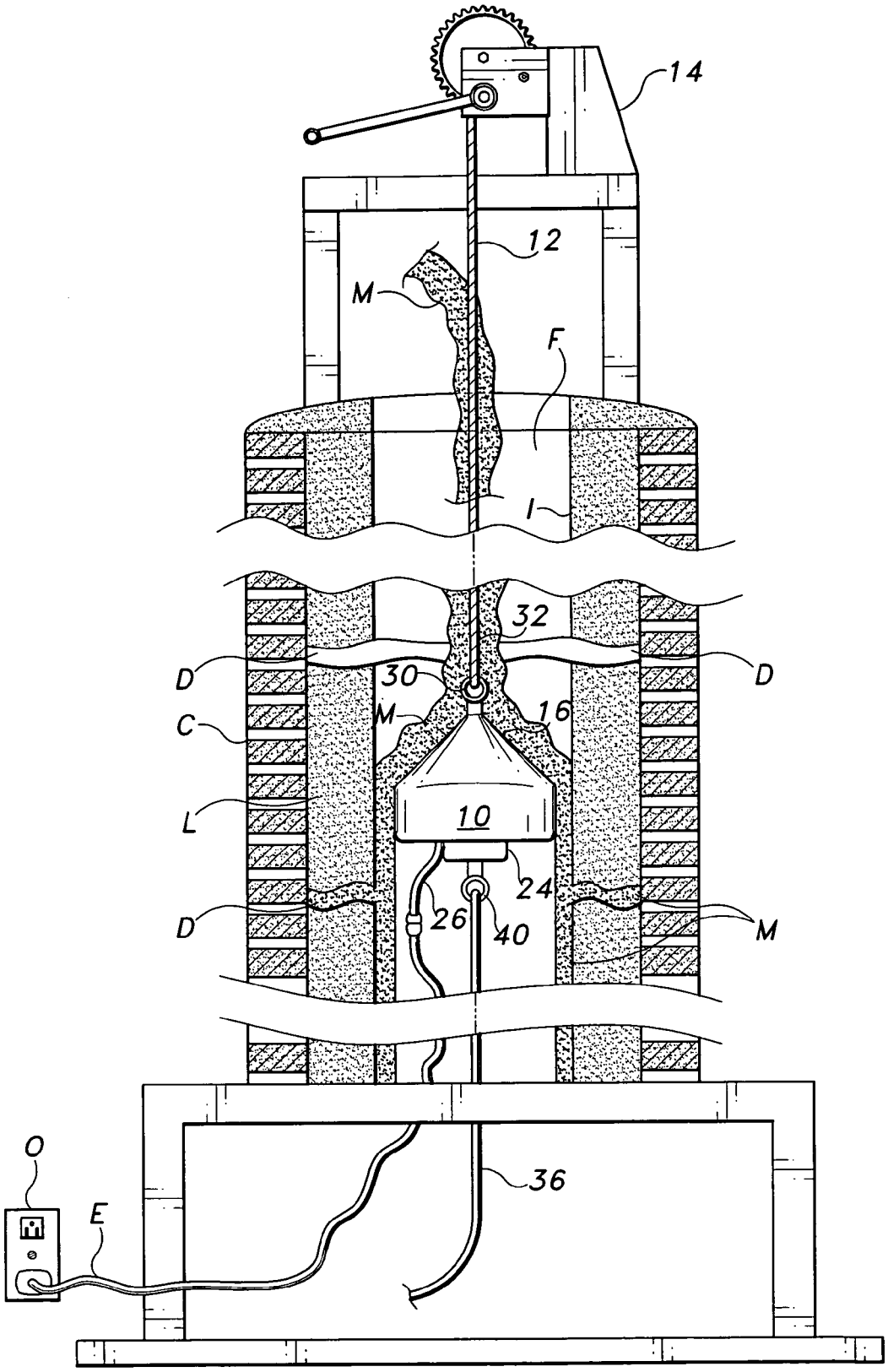
FIG. 1 is an elevation view in section of a chimney and flue liner, showing the structure and operation of the apparatus for masonry chimney flue repair according to the present invention.

FIG. 1 of the drawings provides an elevation view in section of a conventional chimney C and flue liner L (with the thickness of the flue liner L shown somewhat exaggerated, for clarity in the drawing FIG.), with the repair apparatus of the present invention being used therein. The resilient foam applicator 10 is shown being drawn upwardly through the flue liner L by a lifting line 12 which is being wound upon a winch 14. The winch 14 may be hand operated, as shown, or some other power source (electric, etc.) may be provided as desired for the winch. Mortar, grout, or other repair material M in a thickened liquid or somewhat plastic state, is poured downwardly into the chimney flue F, e.g., running downwardly along the lifting cable or line 12, to flow onto the upper end 16 of the applicator 10. The downwardly and outwardly tapered upper end 16 of the applicator 10 causes the repair material M to flow outwardly, where it flows between the lower portion 17 of the applicator 10 and the interior surface I of the flue liner L to form a relatively smooth and even coating of fresh mortar M due to the pressure of the resilient applicator 10 against the flue liner wall.

The applicator 10 is formed of a generally solid, three dimensional block of resilient foam material to have the shape of a geometric solid figure . The applicator is configured to fit closely within the chimney flue F, and may be formed to conform to the interior dimensions of any practicable chimney flue. Most conventional chimney flues are square or rectangular in cross section. The corresponding applicator of the present invention has a lower end portion 17 (shown in FIG. 2) with a corresponding square or rectangular cross section of about the same dimensions as the interior of the chimney flue, with the upper end 16 having a pyramid shape to cause the repair material M to flow downwardly and outwardly therefrom. However, some flues may have a circular cross section. The lower portion of a corresponding applicator may have a corresponding cylindrical shape, with the upper end portion having a conical shape. The construction of the present applicator 10 of an easily workable resilient foam material, allows the applicator 10 to be formed and modified as required to fit virtually any chimney flue configuration. An elastomer coating 18 (shown in FIG. 2), e.g., a tripolymer material, may be applied over the exterior of the applicator 10 in order to preclude the adhesion of the mortar repair material M thereto.

As the applicator 10 is drawn upwardly through the chimney flue F, its closely fitting shape within the flue F forces the repair material M against the interior walls or surface I of the flue liner L. The fluid mortar or grout repair material M is also forced into any gaps, cracks, crevices, and/or other discontinuities D in the flue liner L, as can be clearly seen in the portion of the flue F below the applicator 10 in FIG. 1, which the applicator 10 has already passed. The applicator 10 also preferably includes an electrically powered vibrator device, which serves to tamp or pack the repair material M further into the flue liner discontinuities D. This serves to essentially fill such discontinuities D completely, as shown in the discontinuity D below the applicator 10 in FIG. 1, thus assuring the integrity of the repair and precluding any subsequent "hot spots" or other hazardous conditions once the repair has been completed.

Figure 2:
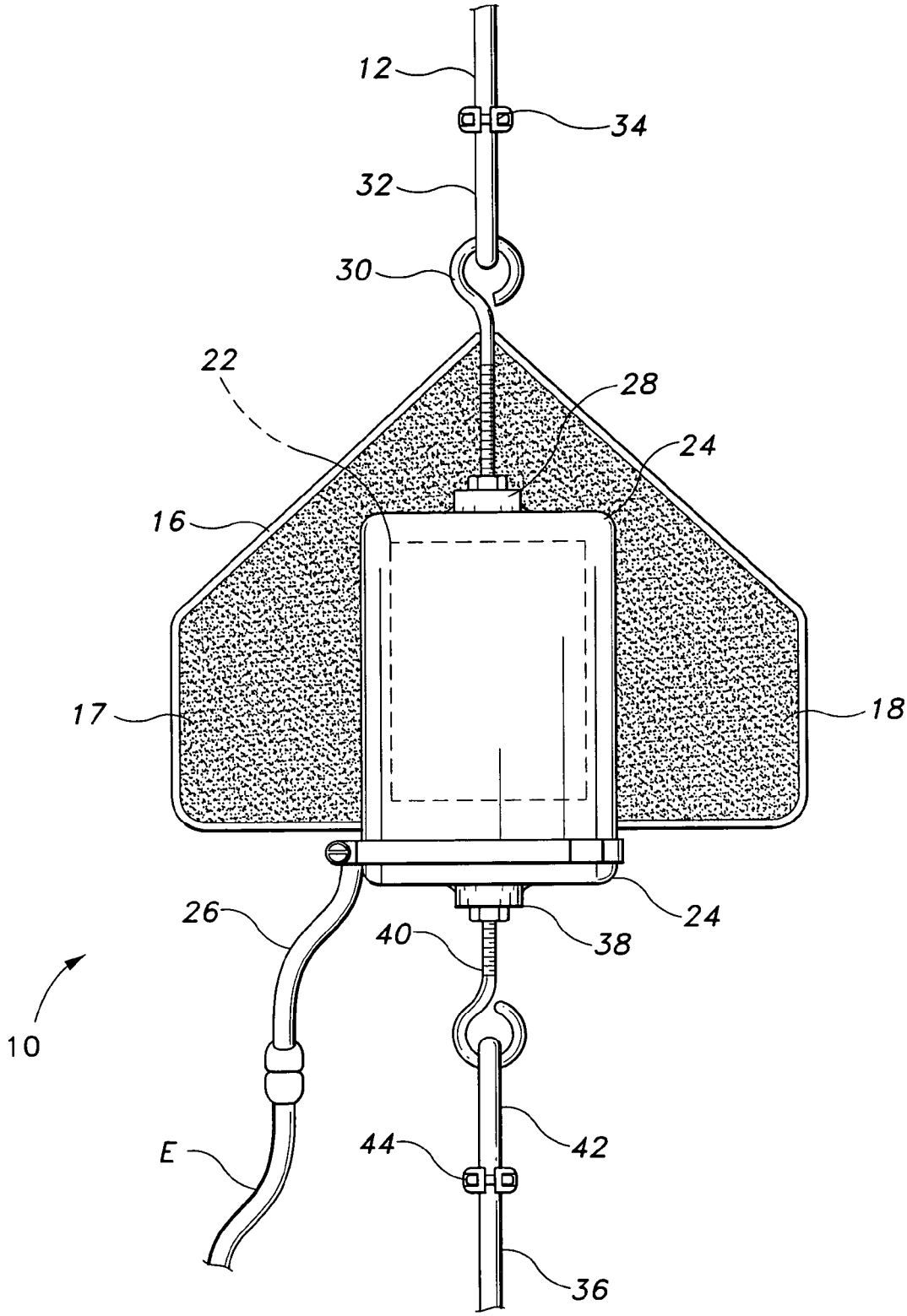
FIG. 2 is a detailed elevation view in section of the mortar or grout applicator of the present invention, showing the electrically powered vibrator installed therein and other features thereof.

FIG. 2 provides a detailed elevation view in section of the present applicator 10. The applicator 10 is primarily formed of a three dimensional block of resilient sponge-like material 20, as noted further above. The foam core 20 is then coated with a non-porous elastomeric coating 18, to prevent the mortar or grout repair material M from adhering to the foam core 20. A portion of the foam core 20 is hollowed to provide room for the installation of an electrically powered vibrator 22 therein (shown in broken lines in FIG. 2), with the vibrator 22 preferably enclosed in a canister or housing 24 having a rigid shell (aluminum or other metal, etc.). The vibrator 22 is of conventional construction, e.g. an electric motor which rotates an eccentric weight, or other operating principle known and used to produce vibrational forces. Electrical power is provided by an electrical cord 26, which connects to a conventional extension cord E which may draw electrical power from any suitable source, e.g., a conventional household electrical outlet O, as shown in FIG. 1.

The lifting line 12 may be attached to the upper end portion 16 of the applicator 10 in any suitable and structurally sound manner. One such attachment manner is the provision of a threaded boss 28 extending from the upper end of the vibrator housing 24, into which a threaded eye bolt 30 is secured. A loop 32 is formed in the lower end of the lifting cable or line 12, and secured by a cable clamp 34 or other suitable means. The lifting cable or line loop 32 and the eye of the eye bolt 30 connect to one another, allowing the applicator 10 to be lifted by means of the lifting line or cable 12 and winch 14. Preferably, a draw down line or cable 36 extends from the lower end of the applicator 10, for pulling the applicator 10 downwardly from the top of the chimney C prior to initiating the application of the repair material M within the flue liner L. The draw down line 36 depends from the lower end portion 17 of the applicator 10, or more specifically, from a threaded boss 38 extending from the bottom of the vibrator housing 24. A lower eye bolt 40 is secured to the lower boss 38, with the draw down cable 36 having a loop 42 formed therein and held by a cable clamp 44 or the like. The draw down cable loop 42 engages the eye of the lower eye bolt 40, in the manner of the lifting cable or line eye bolt 30 and cable 12 connection described further above.

Figure 3:
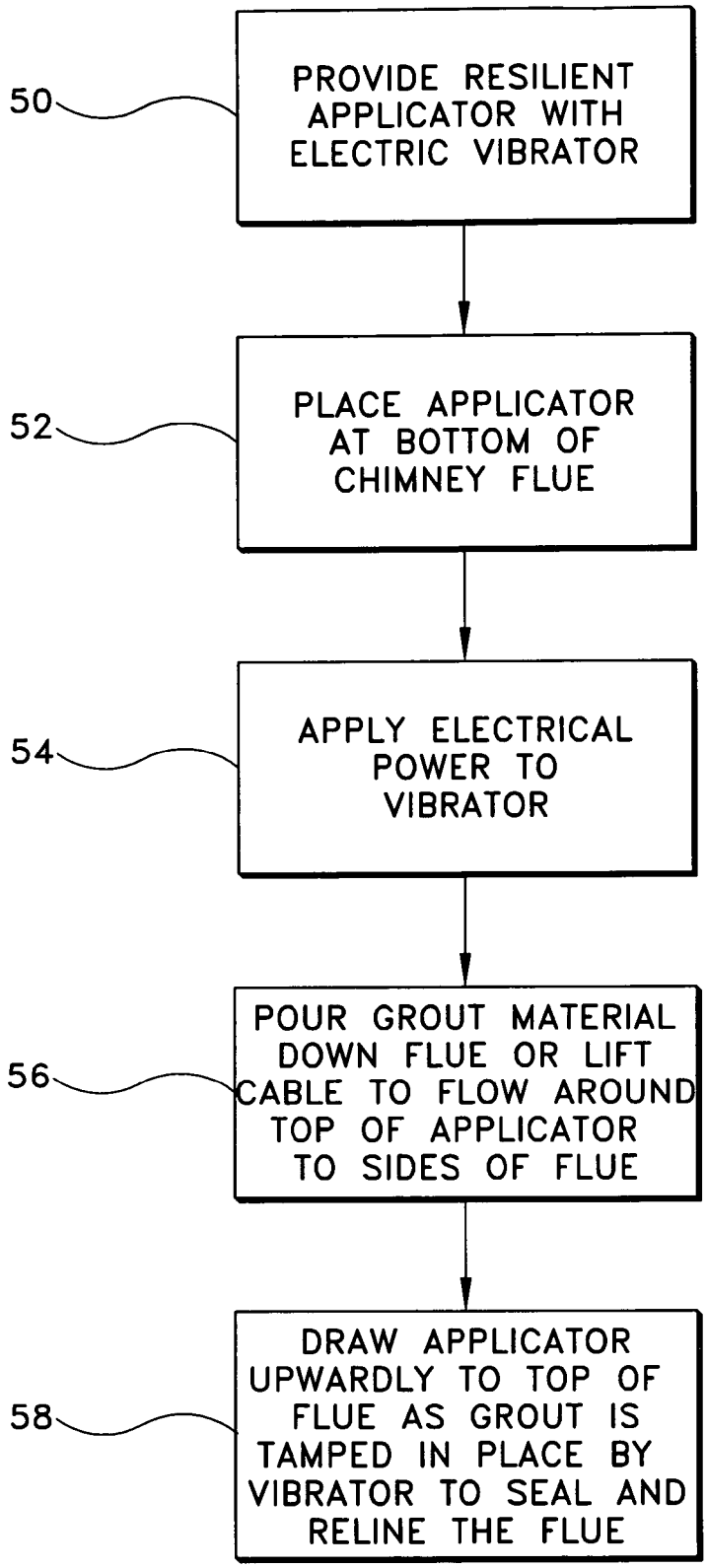
FIG. 3 is a flow chart describing the basic steps in the method of repairing a chimney flue liner or the like, using the apparatus of the present invention.

The present disclosure also describes the method of using the present applicator, with the basic steps in the method being shown in the flow chart of FIG. 3 of the drawings. The basic components of the present invention, i.e., the applicator 10 with its vibrator device 22, lifting line 12 and winch 14, and draw down line 36, are assembled at the job site, generally as indicated by the first step 50 of FIG. 3. The winch 14 is placed atop the chimney cap and above the flue, generally as indicated in FIG. 1. The present applicator 10 is used essentially by drawing the device upwardly through the chimney flue while fresh mortar or other repair material is poured downwardly through the chimney, where it is smoothed into place by the applicator. However, before the actual application of the mortar repair material can begin, the applicator 10 must be positioned at the bottom of the chimney flue F, as indicated by the second step 52 of FIG. 3. This is accomplished by means of the draw down cable or line 36, which is dropped down the chimney flue F. The draw down line or cable 36 is then drawn through the flue F while the lifting line 12 is freed from the winch 14, pulling the applicator 10 downwardly through the relatively tight confines of the chimney flue liner L.

When the applicator 10 is positioned at the lower end of the chimney flue F, electrical power may be supplied to the vibrator 22 and the mortar or grout material M poured down the chimney flue F, generally in accordance with the third and fourth steps 54 and 56 of the flow chart of FIG. 3. (The exact order of these two steps 54 and 56 is not critical, so long as vibratory power is being applied to the applicator 10 when the mortar or grout repair material M reaches the sides of the flue liner and any discontinuities therein.) The mortar or grout repair material M is in a relatively viscous state, and flows relatively slowly. It may be poured along the lift cable 12 or directly atop the upper end of the applicator 10, as desired. Pouring the material M along the lift cable 12 assures more equitable distribution of the material M over the tapered upper end portion 16 of the applicator 10, whereupon the material M flows downwardly and outwardly to flow between the applicator 10 and the inner surface I of the flue liner L.

The close fit of the applicator 10 within the chimney flue liner L, along with the vibration from the internal vibrator device 22, results in the viscous mortar or grout material M being shaken downwardly between the sides of the applicator 10 and the flue liner L. The vibrations serve to tamp or pack the repair material M solidly against the interior walls I of the flue liner L, and also serve to drive the repair material M deeply into any cracks, crevices, gaps, or other discontinuities D which may exist in the flue liner L. As the mortar repair material M flows down the sides of the applicator 10, additional material M is poured down the flue F as the applicator 10 is slowly drawn up the chimney flue liner F by means of the lifting line 12 and winch 14, generally in accordance with the final step 58 of the flow chart of FIG. 3. Once the work has been completed, the portable winch 14 is removed and any excess mortar or grout repair material M is cleaned from the lift cable 12 and/or any other equipment, whereupon the present applicator 10 and equipment are ready for further use.

In conclusion, the present masonry chimney repair apparatus and method serve to provide a much improved means of accomplishing such repairs. The present resilient foam applicator, with its internal vibrator device, results in extremely good penetration and filling of any cracks, crevices, gaps, and/or other voids or discontinuities within the flue liner. The present applicator is relatively economical to manufacture and purchase, particularly in comparison with other flue repair devices formed of multiple panels of rigid sheet metal and the like. The vibrational qualities of the resilient material, in combination with the vibrator device installed therein, assure that the mortar repair material is forced deeply into any cracks, crevices, and fissures within the flue liner. The resulting repair serves to prolong the life of the chimney and flue liner to a considerable degree, while being considerably more economical than other repair means or rebuilding the chimney and flue.

It is to be understood that the present invention is not limited to the sole embodiment described above, but encompasses any and all embodiments within the scope of the following claims.

I claim:

1. An apparatus for repairing irregularities in a chimney flue liner, comprising:

an applicator formed of a resilient foam material, and having a geometrically solid configuration with an upper end and a lower end opposite said upper end;

a lifting line attached to the upper end of said applicator for drawing said applicator through the chimney flue liner and distributing a mortar material therein; and, an electrically powered vibrator disposed within said applicator for tamping the mortar material firmly into the irregularities within the flue liner, said electrically powered vibrator selectively causing an exterior surface of said applicator to vibrate, whereby the mortar material flowing over said exterior surface is driven by the selectively vibrating exterior surface into the irregularities within the flue liner.

2. The chimney flue liner repair apparatus according to claim 1, further including a draw down line extending from the lower end of said applicator.

3. The chimney flue liner repair apparatus according to claim 2, further including:

a rigid housing surrounding and containing said vibrator, said applicator substantially surrounding and encasing said housing, said lifting line being connected to said housing.

4. The chimney flue liner repair apparatus according to claim 3, further including a draw down line connected to said housing and depending therefrom.

5. The chimney flue liner repair apparatus according to claim 1, further including an elastomer coating disposed over said applicator.

6. The chimney flue liner repair apparatus according to claim 1, further including a lifting line winch disposed above said applicator and communicating therewith by said lifting line.

* * * * *